United States Patent [19]

Hildebrand et al.

[11] Patent Number: 4,941,618

[45] Date of Patent: Jul. 17, 1990

[54] NEBULIZER EMPLOYING A FINE MESH SCREEN

[75] Inventors: Karl J. Hildebrand, Tyngsboro; John Urh, Stoneham, both of Mass.

[73] Assignee: Leeman Labs Inc., Lowell, Mass.

[21] Appl. No.: 882,686

[22] Filed: Jul. 7, 1986

[51] Int. Cl.[5] ..... B05B 7/00

[52] U.S. Cl. ..... 239/432; 128/200.14; 239/590.3

[58] Field of Search ..... 261/78.2, 65, 106; 128/200.14, 200.21, 204.13; 239/338, 343, 370, 432, 590.3; 169/15

[56] References Cited

U.S. PATENT DOCUMENTS

| | | | |
|---|---|---|---|
| 1,716,755 | 6/1929 | Bastian | 261/78.2 |
| 2,715,045 | 8/1955 | Thompson | 239/343 |
| 3,270,965 | 9/1966 | Aghnides | 239/432 X |
| 3,342,271 | 9/1967 | Anthony, Jr. | 169/15 |
| 3,823,926 | 7/1974 | Beacich | 261/106 |

*Primary Examiner*—Andres Kashnikow

*Attorney, Agent, or Firm*—John M. Brandt

[57] ABSTRACT

A nebulizer for producing a quantity of fine liquid droplets consisting of a screen over which the liquid to be nebulized is flowed and a nozzle for directing a stream of gas at the screen. The force of the gas against the screen creates the droplets by shearing the liquid from the spaces in the mesh. A second screen in front of the first may be used to increase the uniformity of the output.

2 Claims, 1 Drawing Sheet

NEBULIZER EMPLOYING A FINE MESH SCREEN

BACKGROUND OF THE INVENTION

1. Field of the Invention

The invention resides in the field of nebulizers for producing fine liquid droplets or aerosols.

2. Description of the Prior Art

A variety of types of nebulizers exist in the prior art. There are, for example, concentric nebulizers in which a flowing stream of liquid is concentrically introduced into the center of a surrounding high velocity stream of gas. When the liquid and gas are brought into contact at the tip of the nebulizer, the emerging gas shears and vibrates the liquid through turbulence breaking it into fine droplets. There are some drawbacks to this design, specifically because of the need for small dimensions and close tolerances, a tendency of the apparatus to clog from the small particles which may be contained in the sample. Dimensional changes with changes in temperature may also be a problem which is normally solved by using glass for construction. Glass as a material is obviously very delicate and cannot be used with hydrafluoric acid.

Cross-flow nebulizers work on the same principle of turbulence and shearing except that the liquid stream and gas stream interact at a right angle rather than concentrically. This approach is equally subject to the problem of clogging when small diameter liquid tubes are used. Additionally, the alignment of the gas and liquid orifices is critical and may drift due to thermal expansion and material creep.

A somewhat different form of cross-flow nebulizer uses a slot or sluiceway instead of a tube for conveying the liquid to the gas. Clogging is less likely to occur but liquid flow cannot be well controlled. Thus where precision is required, in analytical instruments for example, this form of nebulizer is not well suited.

An entirely different approach is to be found in the design of ultrasonic nebulizers. In these, the liquid is brought into contact with a vibrating crystal whereupon the vibrational energy is transferred to the liquid and results in the desired break-up. These types are used primarily in analytical applications, and while more efficient than the above described pneumatic devices, they are subject to a lack of repeatability in cases where the liquid contains salts or organic material which leave a coating on the transducer. In addition, again in comparison to the pneumatic types, they are large, expensive, and awkward to handle.

In contrast, the invention disclosed herein is a unique departure in concept from the devices described above.

SUMMARY OF THE INVENTION

The invention may be summarized as a pneumatic form of nebulizer in which a gas stream is directed by a nozzle at a fine mesh screen over which is flowed the liquid to be fractured or divided into fine droplets. The screen is substantially greater in area than the cross-sectional area of the gas stream. At the same time, the mesh of the screen is much finer than the gas stream resulting in the breaking up of the liquid as it is sheared away from or blown out of the screen mesh. The parameters of the device will depend upon the liquid being acted upon, its flow rates, and the size of the droplets desired but they obviously include the size of the mesh, the velocity and size of the gas stream, and the number of screens.

There are a number of advantages to the invention over the prior art. For example, the fine mesh screen supplies many apertures within the flowing gas stream to provide a multiplicity of shear surfaces. This results in an increase in efficiency and more importantly an increase in repeatability when the invention is used in analytical instruments such as spectrometers. The many surfaces act to average any irregularities or instabilities at any one surface.

Additionally, the total screen or grid area which is uniformly wetted is much larger than the area covered by the flowing gas. As a result the relative positions of the screen and gas nozzle are less critical than in prior devices making this apparatus easier to construct and maintain and very insensitive to dimensional changes caused by temperature or material creep.

Also, the supply of liquid can be transported to the screen by a tube large enough to eliminate the possibility of clogging by particulate matter. Further the plurality of apertures created by the screen will also prevent the failure of the device if one portion of the mesh should become blocked.

Additionally, because the area of the screen which is wetted is much greater than the area of nebulization, the wetted area can expand and contract to reduce pulsations where the liquid is introduced intermittently such as occurs from the use of a peristaltic pump. In a refined embodiment, using two screens spaced slightly apart, this smoothing effect is further enhanced, the space between the screens serving to damp the pulsations. The second screen will also serve as an impactor for the droplets produced at the first screen thereby producing a finer mist.

Lastly the screen and any associated mounting assembly can be constructed of materials which are impervious to the corrosive effects from any of a variety of liquids which might be applied to the system.

The features of the invention will be more fully understood from the drawings and description of the preferred embodiment which follow.

DESCRIPTION OF THE PREFERRED EMBODIMENT

Figure 1:
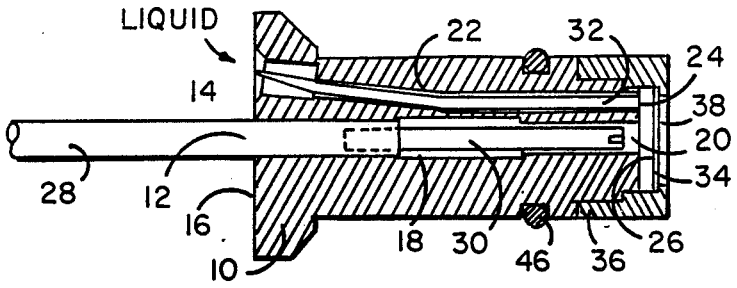
FIG. 1 is a cross-sectional plan view of the preferred embodiment of the invention.

Referring to FIG. 1, there is shown a cross-sectional illustration of the preferred embodiment in which mounting body 10 has gas access port 12 and liquid access port 14 disposed in rear face 16.

Passage 18 is disposed in body 10 for conveying gas under pressure to exit port 20. Similarly, passage 22 in body 10 provides for the transport of liquid to exit port 24, at the opposite face 26 of the body.

Tube 28 is inserted in passage 18 and joins tube 30 for the purpose of providing a pressurized gas stream from a source not shown. Tube 32 is inserted in passage 22 to facilitate the transport of liquid through body 10. At the forward face 26 of body 10, a fine mesh screen 34 is held in position against the face and exit ports 20 and 24 by cap 36.

Optionally, a second screen, 38 to provide an additional shear surface may be mounted forward of the first screen 34. Also the gas stream may be modified to produce a particular dispersion pattern by the insertion of an appropriate blocking element 40 in exit port 20.

Figure 2:
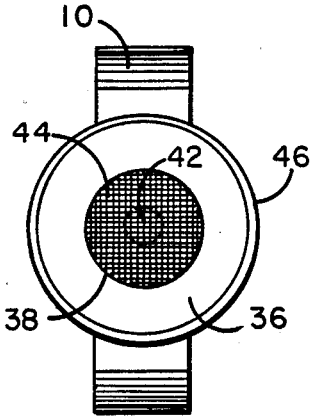
FIG. 2 is a front view of the device of FIG. 1.

As shown in FIG. 2, screen 34 and screen 38 are of substantially greater area than the cross-section of any gas stream 42 which would emerge from exit port 20. Commensurately, the size or width of the screen mesh 44 should be substantially smaller than the diameter of the gas stream for the most uniform results.

The embodiment illustrated is particularly suited for use with a Scott spray chamber which is employed in many inductively-coupled plasma spectrometers. To that end, an O-ring 46 is disposed in groove 48 to provide a proper seal for use within such a chamber.

As will be obvious, to operate the herein-described nebulizer, it is only necessary to introduce a subject liquid and appropriate gas into the respective access ports. The liquid will then wet the screen and be nebulized and forced away from the unit by the pressure of the gas emanating from the exit port.

What is claimed is:

1. A nebulizer for producing a quantity of fine liquid droplets from a liquid comprising in combination:

a. a nozzle for producing and directing a stream of gas;

b. a fine mesh screen positioned to receive said stream of gas, said screen of substantially greater area than that of the cross-section of said stream and the width of the mesh of said screen substantially smaller than the diameter of said stream; and c. means for flowing said liquid over said screen whereby said droplets are created by the shearing action of said stream impinging on said screen and said liquid.

2. The apparatus of claim 1 further including a second screen disposed forward of said first screen.

* * * * *